United States Patent [19]

Hatten et al.

[11] 4,159,769

[45] Jul. 3, 1979

[54] VENDING MACHINE ADAPTER

[76] Inventors: Philip A. Hatten, 1909 N. Beachwood Dr. #20, Hollywood, Calif. 90068; Jerome H. Hyman, 108 S. Las Palmas Ave., Los Angeles, Calif. 90004

[21] Appl. No.: 837,914

[22] Filed: Sep. 29, 1977

[51] Int. Cl.[2] ..... B65D 1/34; B65D 1/36

[52] U.S. Cl. ..... 206/527; 206/563; 221/44; 221/241

[58] Field of Search ..... 206/527, 525, 526, 318, 206/814; 229/2.5; 220/20; 221/241, 242, 44

[56] References Cited

U.S. PATENT DOCUMENTS

| | | | |
|---|---|---|---|
| 3,080,964 | 3/1963 | Robinson et al. | 206/318 |
| 3,776,374 | 12/1973 | Medendorp | 229/2.5 |
| 3,997,092 | 12/1976 | Pogwizd | 206/814 |

*Primary Examiner*—William T. Dixson, Jr.
*Attorney, Agent, or Firm*—Spensley, Horn & Lubitz

[57] ABSTRACT

A vending machine adapter to allow items not normally suited to being vended through a particular vending machine to be vended. The vending machine adapter includes a container of substantially the same size and shape as the item normally vended by the particular vending machine and at least one recess provided in the container for holding the item or items normally not vended.

3 Claims, 5 Drawing Figures

Fig. 1
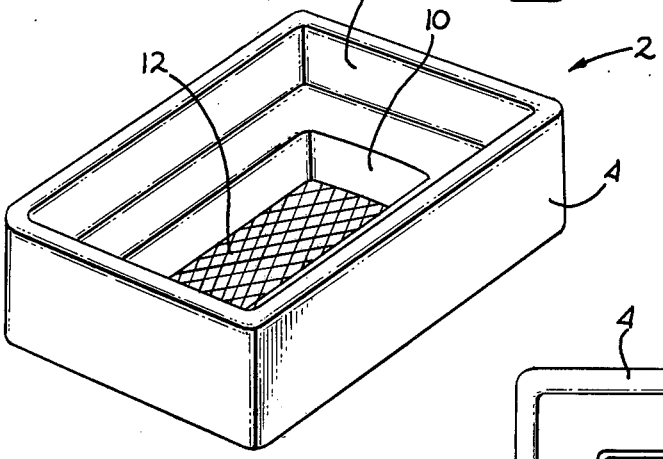
Fig. 2
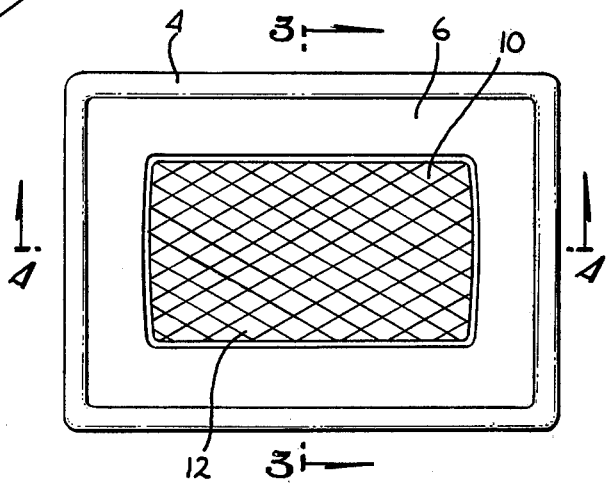
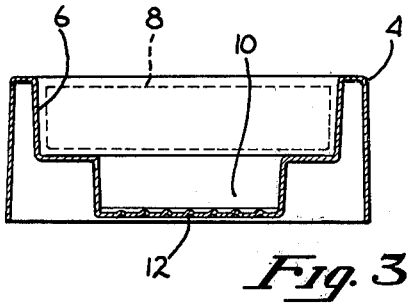
Fig. 3
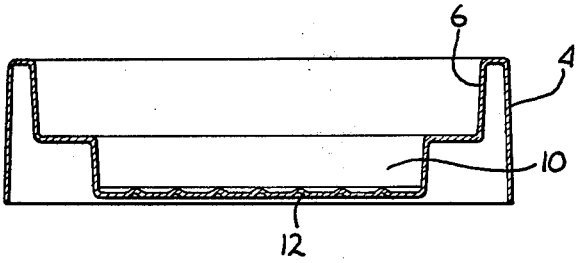
Fig. 4
Fig. 5
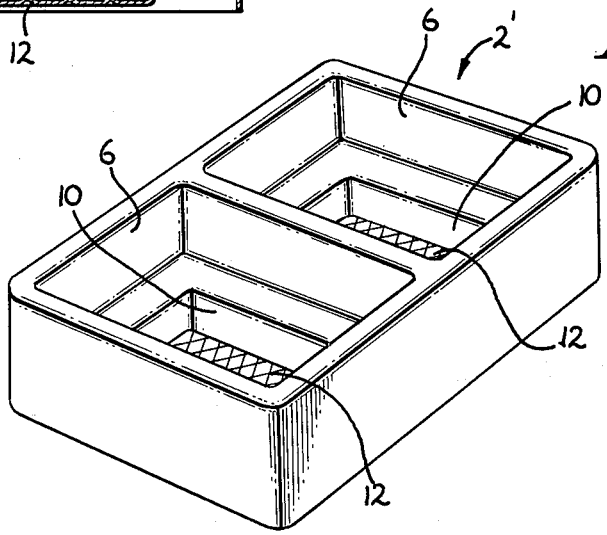

VENDING MACHINE ADAPTER

FIELD OF INVENTION

This invention relates to vending machines and more particularly to items used in conjunction with vending machines.

DESCRIPTION OF THE PRIOR ART

Vending machines are typically found at various locations all over a city, town, area and throughout the United States. Such vending machines are typically designed to vend an item of a particular size and shape. As a result of only being able to vend a particular item of a particular size and shape, prior art vending machines have one major difficulty. This difficulty is that if the owner of the vending machine desires to now vend an item of a different size and shape, he must go to a great expense and purchase a new machine capable of vending the new item.

In an attempt to overcome this difficulty, vending machines have been designed with adjustment means to allow the machine to vend items of various sizes and shapes. These types of vending machines also have various drawbacks. The first is that they are more complex and therefore more costly. The second is that the range of adjustment is limited thereby limiting the number of items which could be vended through the particular machines.

Accordingly, it is a general object of the present invention to provide a means to allow items which are not normally suited to being vended through a particular machine to be vended.

It is another object of the present invention to provide a means to allow items not normally suited to be vended through a particular machine to be vended which is simple and low in cost.

SUMMARY OF THE INVENTION

In keeping with the principles of the present invention, the objects are accomplished by a vending machine adapter which allows items not normally suited to be vended through a particular vending machine to be vended. The vending machine adapter includes a container of substantially the same size and shape of the item normally vended by the particular vending machine and at least one recess provided in the container for holding the item or items not normally vended.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which:

FIG. 1 is a perspective view of the vending machine adapter in accordance with the teachings of the present invention;

FIG. 2 is a top plan view of the vending machine adapter of FIG. 1;

FIG. 3 is a sectional view of the vending machine adapter of FIG. 2 looking along the lines 3—3;

FIG. 4 is a sectional view of the vending machine adapter of FIG. 2 looking along the lines 4—4; and FIG. 5 is a perspective view of a second embodiment of a vending machine adapter in accordance with the teachings of the present invention.

DETAILED DESCRIPTION OF THE INVENTION

Referring more particularly to the drawings, shown in FIGS. 1, 2, 3 and 4 are one embodiment of a vending machine adapter in accordance with the teachings of the present invention. The vending machine adapter 2 includes a container 4. Typically, the container 4 is designed such that its size and shape is substantially the same as the item which is normally vended by the particular vending machine. The container 4 is provided with a first recess 6. The first recess 6 is typically of approximately the same size and shape as the item which it is desired to vend so that it can hold such item 8 as shown by the phantom lines in FIG. 3. Formed in the bottom of the first recess 6 is a second recess 10. Also shown in FIG. 3 is the fact that the first recess 6 and second recess 10 form a inwardly extending ledge member thereinbetween. The item 8 rests on such ledge member. The second recess 10 is smaller than the first recess 6 and is provided to increase the strength of the container 4 and also to provide a base on the underside of the container 4 for a cellophane wrap which would be typically wrapped around a container 4 after the item desired to be vended is placed in the first recess 6. The bottom surface of the second recess 10 is provided with a diamond shaped waffle pattern 12. This diamond shaped waffle pattern is provided to increase the strength of the container 4.

In practice the container 4 may be made from a plastic, cardboard or metal. Furthermore, the adapter 2 may be formed by any prior art method such as vacu-forming, die casting, injection molding, etc.

In operation, the item desired to be vended is placed into the first recess 6. The adapter 2 is then wrapped in a cellophane or the like transparent wrap to seal the item to be vended 8 into the adapter 2. The adapter 2 is then placed in a desired particular vending machine for vending. Accordingly, by the use of such an adapter 2, an item which could not normally be vended through a particular vending machine can be vended without increasing the complexity and cost of the vending machine through the use of a low cost adapter 2.

Referring to FIG. 5, shown therein is a second embodiment of a vending machine adapter in accordance with the teachings of the present invention. In FIG. 5 the vending machine adapter 2' is substantially the same as that shown in the first embodiment except that instead of being capable of only containing one item, it is provided with two first recesses 6 so that it may contain two items. In all other ways the second embodiment of FIG. 5 is substantially the same as that of the first embodiment.

It should be apparent to one skilled in the art that the vending machine adapter may have more than two first recesses such that it is capable of containing more than two items desired to be vended. In addition, it should be apparent that two or more items to be vended could be stacked in a single first recess. Also, even though the vending machine adapter 2 has been shown in a rectangular shape which is reminiscent of a cigarette pack, the vending machine adapter 2 could be made in any other shape which is suitable for the particular vending machine. Furthermore, if strength is not essential, the container may be formed with only a first recess 6.

In all cases, it is understood that the above described embodiments are merely illustrative of but a few of the many possible specific embodiments which represent the applications of the principles of the present invention. Numerous and varied other arrangements can be readily devised by those skilled in the art without departing from the spirit and scope of the invention.

We claim:

1. A vending machine adapter for allowing an item not normally capable of being vended through a vending machine to be vended, said adapter comprising a generally rectangular container of substantially the same size and shape as a package of cigarettes normally vended by a vending machine, said container having one recess configured to hold said item normally not capable of being vended, and a second recess adjacent the bottom of said first recess, said second recess being smaller than said first recess and configured to increase the strength of said container, said first and second recesses forming a ledge thereinbetween upon which said item normally not capable of being vended is seated.

2. A vending machine according to claim 1 wherein additional recesses are provided in said container configured to hold a second item normally not capable of being vended.

3. A vending machine adapter according to claim 1 wherein said second recess is provided with a diamond shaped waffle pattern adjacent the bottom thereof.

* * * * *